US007156781B2

(12) United States Patent
Talo

(10) Patent No.: US 7,156,781 B2
(45) Date of Patent: Jan. 2, 2007

(54) DEVICE FOR PERSON'S MUSCULAR EXERCISE

(76) Inventor: Jean-Louis Talo, 50, Val carei, Menton (FR) F-06500

( * ) Notice: Subject to any disclaimer, the term of this patent is extended or adjusted under 35 U.S.C. 154(b) by 219 days.

(21) Appl. No.: 10/476,670

(22) PCT Filed: Mar. 29, 2002

(86) PCT No.: PCT/FR02/01106

§ 371 (c)(1),
(2), (4) Date: Nov. 4, 2003

(87) PCT Pub. No.: WO02/089924

PCT Pub. Date: Nov. 14, 2002

(65) Prior Publication Data

US 2004/0132588 A1 Jul. 8, 2004

(30) Foreign Application Priority Data

May 4, 2001 (FR) ..... 01 05952

(51) Int. Cl.
*A63B 21/06* (2006.01)

(52) U.S. Cl. ..... 482/92; 482/93; 482/148

(58) Field of Classification Search ..... 482/92–93, 482/79, 69, 148, 907, 51; D21/662, 685
See application file for complete search history.

(56) References Cited

U.S. PATENT DOCUMENTS

| | | | | |
|---|---|---|---|---|
| 5,158,520 | A | 10/1992 | Yewer, Jr. et al. | |
| 5,284,465 | A | 2/1994 | Homan | |
| 5,454,773 | A * | 10/1995 | Blanchard et al. | 482/133 |
| 5,626,549 | A * | 5/1997 | Olschansky et al. | 482/142 |
| 6,790,194 | B1 * | 9/2004 | Katane et al. | 602/36 |
| 2002/0119872 | A1 * | 8/2002 | Greenheck | 482/93 |

FOREIGN PATENT DOCUMENTS

| | | |
|---|---|---|
| EP | 0 177 017 | 4/1986 |

* cited by examiner

*Primary Examiner*—Lori Amerson
(74) *Attorney, Agent, or Firm*—Young & Thompson

(57) ABSTRACT

A device in particular for use in the field of sport practice and body-building, for a person's muscular exercise. The device enables the development of quadriceps and of the gluteal muscles and comprises a support surface for the feet and elements for applying a force of resistance to the movements of the person's legs to shift from a bent position to an extending position by unfolding the knees. The force applying elements comprise a harness pressing on the upper side of the thighs. The invention is applicable to the manufacture of body-building machine.

13 Claims, 5 Drawing Sheets

DEVICE FOR PERSON'S MUSCULAR EXERCISE

BACKGROUND OF THE INVENTION

The present invention relates to a device for the muscular exercise of an individual.

More particularly, it is usable for developing the quadriceps and the buttocks muscles.

The invention will find its application in the field of the production and use of machines for muscular develoment.

These could be machines for sport or else for functional reeducation.

The musculation of the legs is problematical in the field of bodybuilding particularly.

Thus, the machines known at the present greatly stress the back to permit the application of muscular force at the level of the legs and particularly the quadriceps and the buttocks muscles.

Thus, there are known at present devices for muscular development in which the individual supports weights at the level of the shoulders.

He then performs sitting and rising movements to develop the legs.

It will be easily seen that the back is subjected to substantial force applied by the weights.

Other physical exercises are at present carried out for developing the muscles of the legs.

In particular, it is known to exert resistance at the level of the ankles, the person being then in seated or semi-recumbent position, the legs carrying out an extension of the thighs.

By movements of extension and bending of the leg at the thighs, the individual develops only his quadriceps.

There is known moreover from EP0 177 017 an exercise device for bodybuilding for the development of muscles of the thighs and calves.

The person using this device sits astride an arm mounted as a lever on a frame and connected to the user by a belt.

Weights are placed in front of the level arm and the user exerts physical force at the level of the legs by upward and downward movements.

This device has the drawback of being particularly uncomfortable, the belt having the tendency to cut into the hips of the individual.

Moreover, the belt systematically has the tendency to drop down, which gives an unpleasant feeling to the user.

Another drawback of this device is that it requires the use of a complicated kinematic assembly including a heavy lever arm, which is unaesthetic and costly.

Moreover, the force applied to the body of the individual is concentrated on a curved line about the belt.

This concentration of stress is uncomfortable and also can have physiological repercussions.

SUMMARY OF THE INVENTION

The present invention permits overcoming the drawbacks of the devices used until now, for the development of the muscles of the buttocks and quadriceps.

While doing this, it has the advantage of keeping the feet planted on the floor and applying a force directly to the thighs.

It is thus possible to work the legs of the individual without stressing the back.

The exercise thus has the advantage of being targeted and giving rise to no complication at the dorsal level and particularly pain or even discopathy.

Moreover, the machine according to the invention has an elevated lever arm between the region of application of the force to the body and the point of rotation during movements of the individual (the knees).

Thus, during rising and sitting movements, this lever arm permits reducing considerably the load to be applied relative to the known techniques.

Another advantage of the invention is that the application of the force to the thighs does not give rise to a problem of mechanical resistance, given that the thighs constitute a solid portion of the body and that a large surface of application of the force is obtained at this level.

A small constraint is thus effected on the region in question.

Moreover, the load is adjustable in the course of exercise by modifying the position of the harness along the length of the thighs.

Another object of the invention is to ensure the performance of exercises for muscular development, preserving the proprioceptive reflexes of the individual.

Thus, he carries out normal movements of standing and sitting while continuing to exert a normal pressure of the feet on the ground.

Another object of the invention is to orient the force correctly that is exerted on the thighs relative to the bearing surface for the feet.

In particular, in a preferred embodiment of the invention, the bearing surface for the feet is inclined to reach an optimum result at this level.

The application of resistive force is moreover localized much more near the center of gravity of the individual.

Other objects and advantages will become apparent from the description which follows, which presents successively three preferred modifications of embodiment of the invention, these embodiments however not being limiting.

The present invention relates to a device for the muscular exercise of an individual, usable for the development of the quadriceps and the buttocks muscles, comprising a support surface for the feet and means for application of a resistive force to the movement of the legs of the individual for the passage from a flexed position to an extended position by straightening the knees, characterized by the fact that the means for applying force comprise a harness bearing on the upper surface of the thighs.

This device could take several embodiments set forth hereafter:

- the harness comprises two concave surfaces matching the shape of the upper surface of the thighs;
- the concave surfaces are formed on two members whose spacing and orientation are adjustable and mounted on a plate;

the support surface for the feet is a plane inclined in the longitudinal direction of the feet, rising toward the heels to raise them;

the support surface is perpendicular to the mean direction of the force of resistance;

it comprises a seat for the repose of the individual in bent position;

the means for applying the resistive force comprise:

a cable fixed at one end to the harness, between its support surfaces on the thighs and, at the other end, to a vertically movable load;

return pulleys guiding the cable between the harness and the load;

the means for applying the force comprise:

a transverse bar on which is mounted the harness;

two parallel and oblique guide bars, on which the transverse bar is slidably mounted;

loads distributed at the two ends of the transverse bar, the harness being mounted pivotally in the direction of the transverse bar;

the direction of the guide bars is identical to the mean direction of the resistive force;

it comprises a support of which one surface constitutes the support surface for the feet and has means for securement to the ground, and the means for application of the force comprise one or several elastic connectors connecting the support and the harness;

the means for securement to the ground comprise a tongue in prolongation of the contact surface of the support with the ground, said tongue being adapted to be inserted in the residual slot between a swinging door in the closed position and its threshold.

BRIEF DESCRIPTION OF THE DRAWINGS

The accompanying drawings are given by way of indicative examples and are not limiting. They show a preferred embodiment according to the invention. They permit easy understanding of the invention.

DESCRIPTION OF THE PREFERRED EMBODIMENTS

The device according to the invention is usable by an individual who in this way can develop his quadriceps, his buttocks muscles and his hips.

During these exercises, the individual presses on the floor with his feet on a support surface 6.

The individual moreover carries out movements of passing from a bent position to an extended position of his legs.

These movements take place by alternate extension and bending of the legs.

So as to develop the muscles, these movements of the user take place whilst applying force on his body, in resistance to the extension movement.

According to the invention, this force is concentrated at the level of the thighs of the individual by means of a harness 5 or yoke bearing on the upper surface of the thighs.

The harness 5 transmits at the level of the thighs a resistive force.

Figure 6:
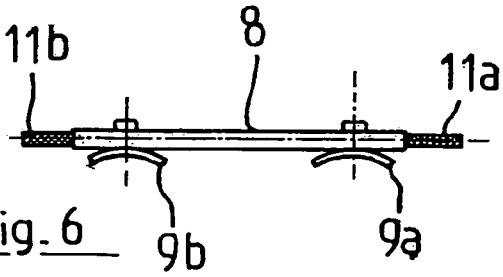
FIGS. 6 to 8 show respectively front, side and top views of the harness permitting applying force to the thighs according to a preferred embodiment.
Figure 7:
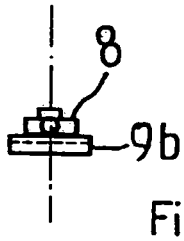
Figure 8:
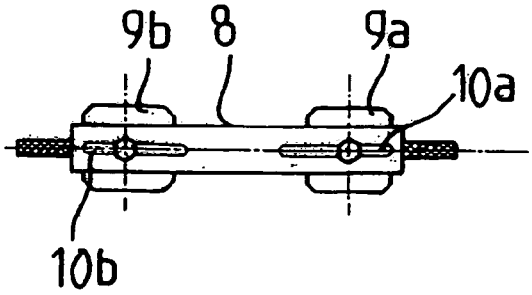

FIGS. 6 to 8 show a preferred embodiment of the harness 5.

In these figures, the harness 5 is constituted by a plate 8 of a shape elongated substantially in the transverse direction to the body of the individual and of a length at least equal to the spacing between the thighs in the normal seated position.

On the plate 8 are fixed two pieces oriented downwardly and having two concave surfaces 9*a*, 9*b* so as to match the upper surface of the thighs of the individual.

Preferably, the pieces carrying the concave surfaces 9*a*, 9*b* have a spacing adjustable by their mounting on the plate 8.

An adjustment of their orientation is also advantageous, by a pivot about their securement point.

As shown, the adjustment is carried out by means of oblong holes 10*a*, 10*b* formed in the plate 8 and a screw-threaded rod receiving a locking nut at its end.

Still preferably, the handles 11*a*, 11*b* are formed on opposite ends of the plate 8 in the longitudinal direction.

The handles 11*a*, 11*b* permit gripping the harness by the individual in a very practical way during his exercises.

In addition to the harness 5, the machine comprises a support surface 6 for the application of the sole of the feet of the user during all his movements of bending and extension.

Preferably, the support surface 6 is an inclined plane as shown in the various FIGS. 1 to 5 and 9 and 10.

This inclined plane is oriented in the direct longitudinal direction of the feet, which is to say toward the front of the person and rises toward the heels so as to raise them.

The given inclination of the support surface 6 permits optimizing the force of the feet of the individual during these movements.

Thus, it is possible to give to the bearing force a direction substantially parallel to the mean direction of the resistive force.

It will be understood by mean direction of the resistive force, the direction taken by the force applied to the thighs by the harness 5 when the individual is about halfway in the path between maximum bending and maximum extension.

Thus, there will be formed an inclination such that the support surface is perpendicular to this mean direction of the resistive force.

In practice, an inclination of the order of 25° of the support surface 6 is suitable.

As an accessory, the device can have a seat 7 permitting the user to rest in seated position.

Figure 1:
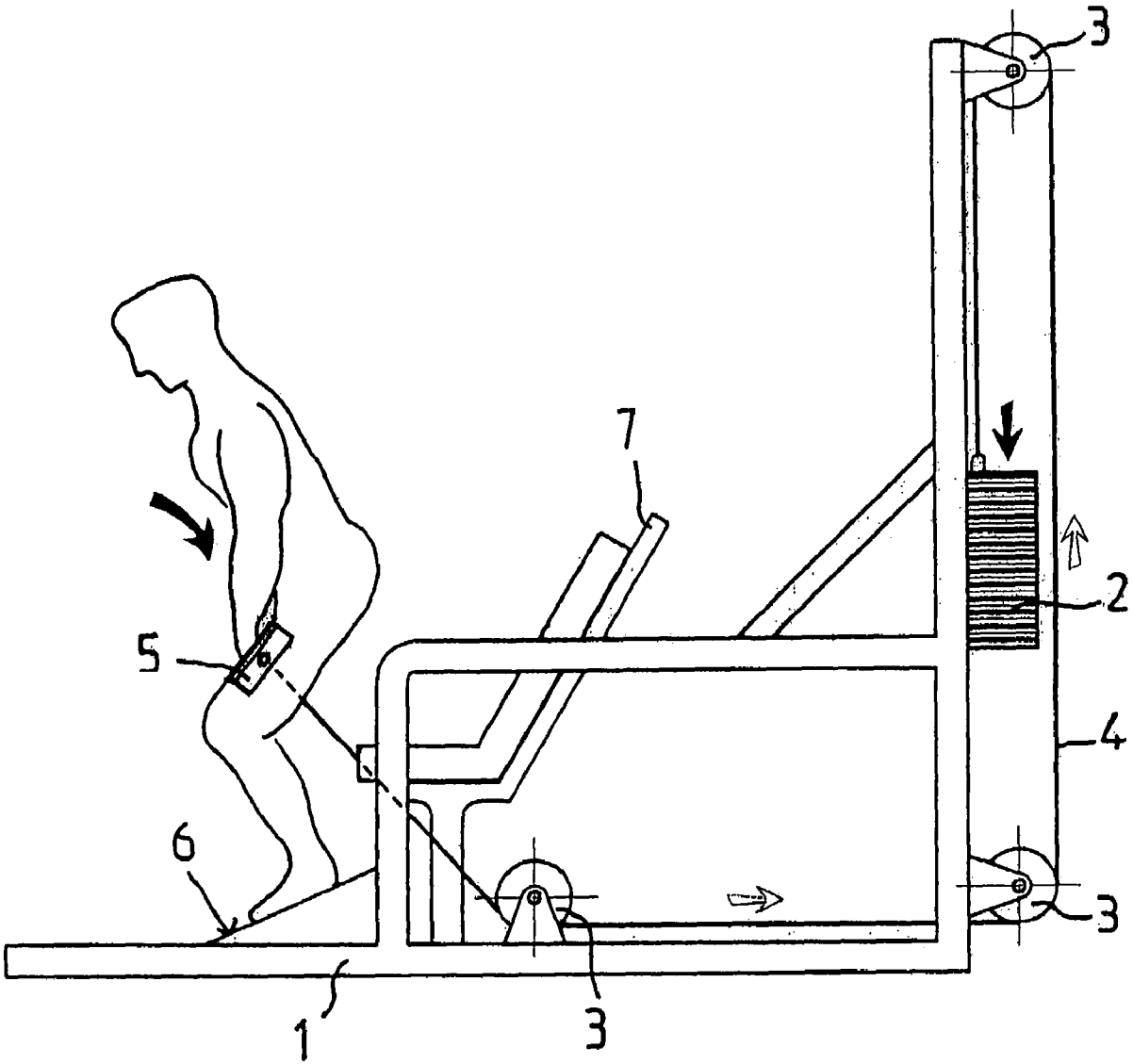
FIG. 1 is a side view of the device according to the invention according to a first embodiment, the user being in a position of partial extension of the legs.
Figure 2:
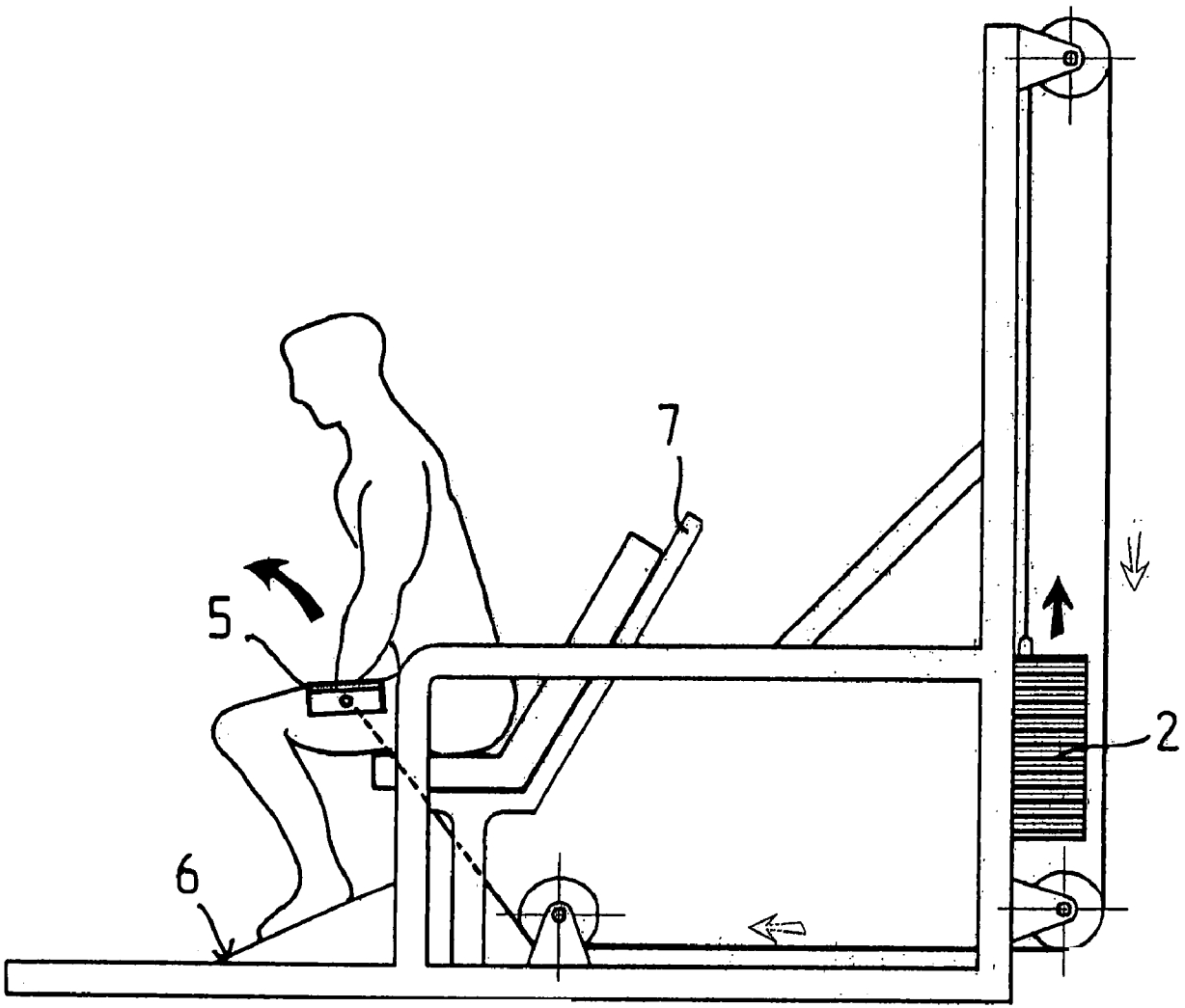
FIG. 2 is a side view of the device according to this same embodiment, when the user is in a seated position.

FIGS. 1 and 2 show a first embodiment of the device according to the invention.

In this framework, the device comprises a frame 1 for example in the form of welded tubing.

According to this modification, the harness 5 is connected to a load 2 that can move vertically by means of a cable 4 and means for transmitting the force and for changing the angle, constituted by pulleys 3.

There can be used pulleys, a cable and loads such as are known at present in the field of sport development.

The cable 4 can moreover be of any nature and suitable for the transmission of a load.

The connection between the cable 4 and the harness 5 is carried out preferably in the medial portion of the plate 8, between the two thighs.

Figures 3, 4:
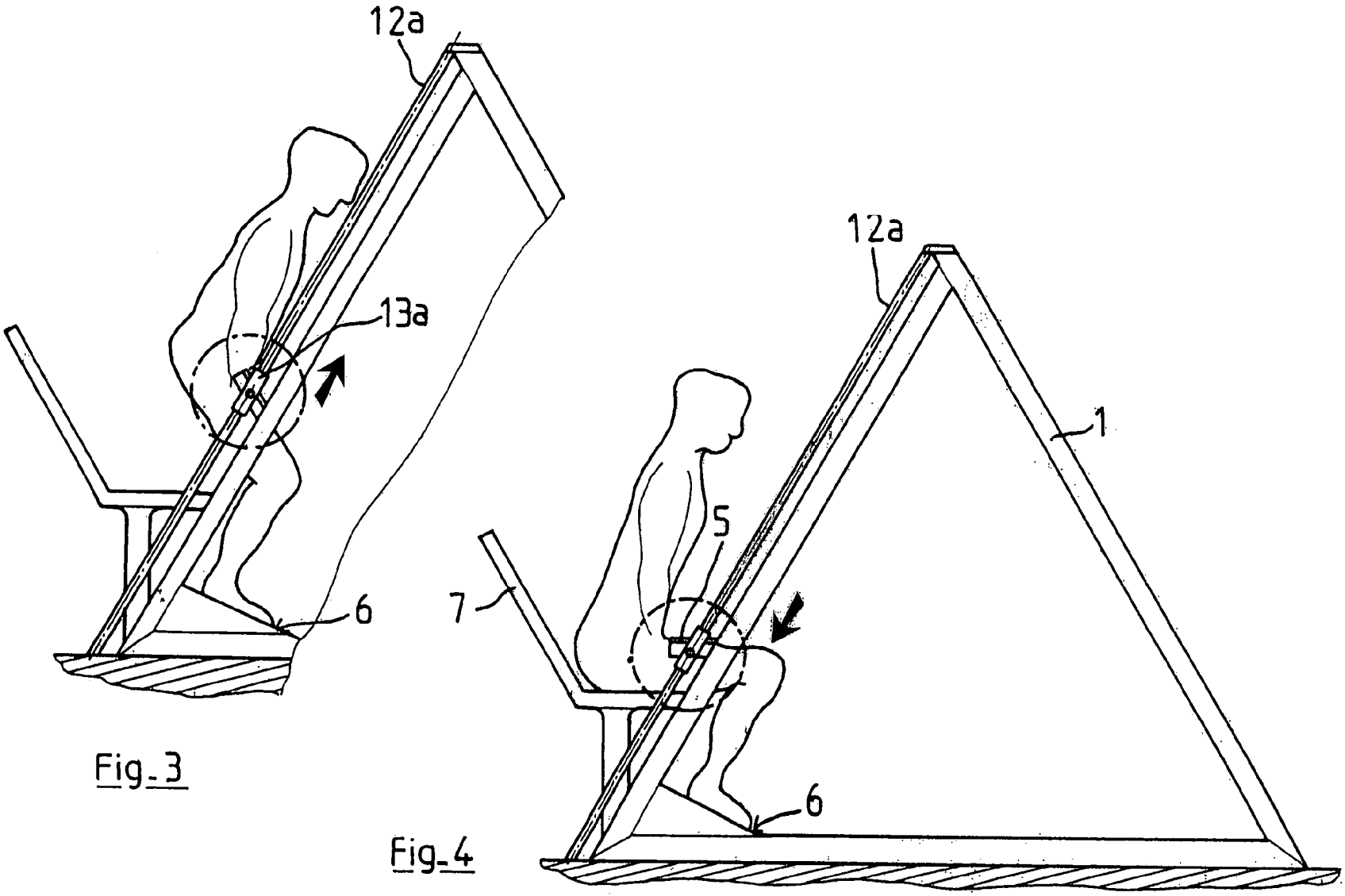
FIG. 3 is a partial view showing a rising movement of the user.
FIG. 4 shows a second modification of the invention in side view, the user being in a seated position.
Figure 5:
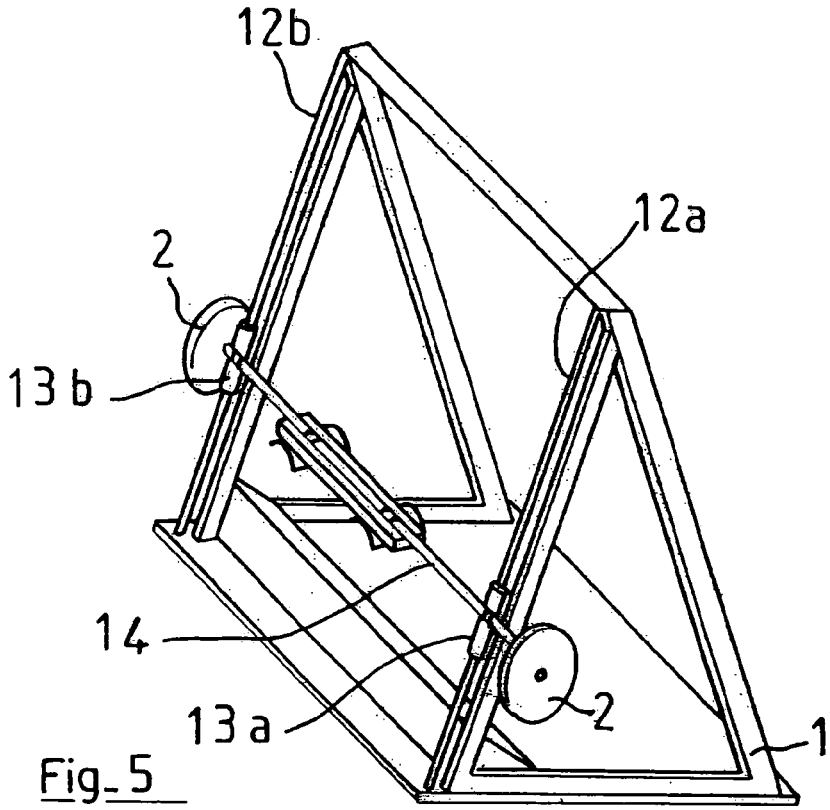
FIG. 5 is a perspective view of the modification of the invention according to FIGS. 3 and 4.

As to the embodiment shown in FIGS. 3 to 5, the device has a frame 1 in the form of a portico provided with triangular tubes connected by an upper transverse beam.

Guide bars 12*a*, 12*b* are connected to the portico in question.

Said bars 12*a*, 12*b* have a same direction and are oblique.

The harness 5 is connected to a transverse bar 14 passing through the harness to return to the guide bars 12*a*, 12*b*.

Freedom of rotation about its longitudinal axis is preserved for the harness 5 relative to the guide bars 12*a*, 12*b*.

According to a first modification, this residual pivot is provided between the transverse bar 14 and the guide bars 12*a*, 12*b* by means of sliding connecting pieces 13*a*, 13*b* as shown in FIG. 3.

That being the case, the residual pivot can be provided by the harness 5 mounted in rotation on the transverse bar 14.

As indicated previously, the transverse bar 14 is mounted slidably on the guide bars 12*a*, 12*b* that are parallel and oblique.

As shown, the obliquity of the guide bars 12*a*, 12*b* is substantially equivalent to the mean direction of the force of resistance applied by the harness to the thighs of the individual.

In this connection, a force of the pushing type is exerted by the individual and this by placing loads 2 distributed on opposite sides of the transverse bar 14 about the thighs of the individual.

The transverse bar 14 thus provided with loads 2 fulfills the function of a weight without thereby stressing the back of the user.

With reference to FIGS. 3 and 4, it will be seen moreover that it is advantageous that the support surface 6 and the bars 12*a*, 12*b* be perpendicular.

Figure 10:
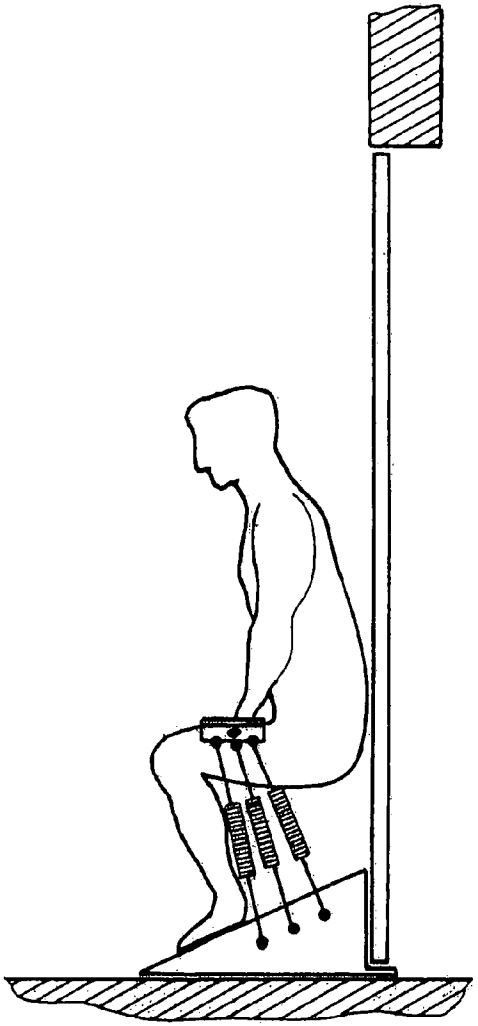
FIGS. 9 and 10 show a third modification of the invention, in the form of a lightweight device.
Figure 9:
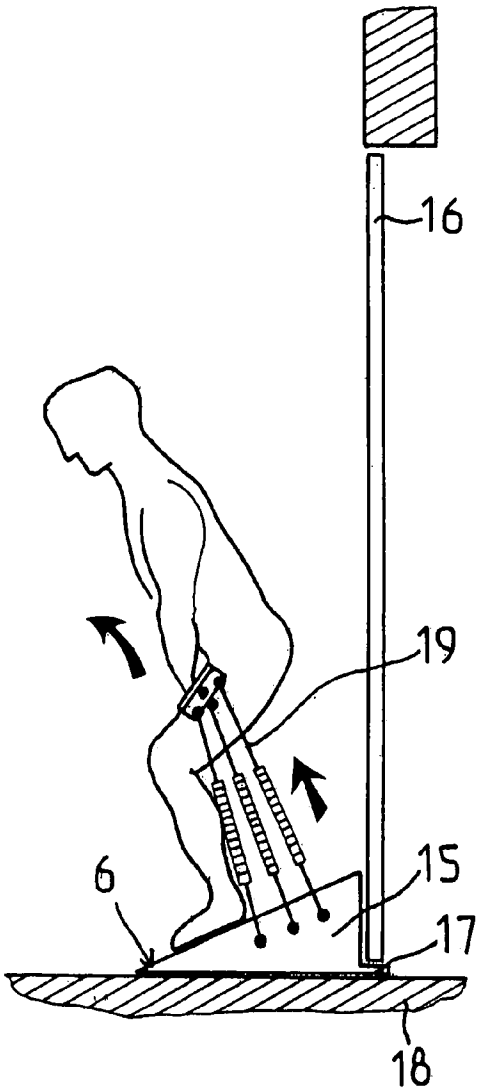

FIGS. 9 and 10 show a third embodiment of the invention particularly adapted for home use.

In this connection, the device comprises a support 15 whose upper surface constitutes the support surface 6 for the feet.

The latter is again preferably inclined as shown.

The support 15 is fixed to the ground by any means used at present or preferably by means of a tongue 17 formed in prolongation of the bearing surface of the support 15 on the ground 18.

By providing a tongue 17 of small thickness, it is possible to insert it into the residual space existing between a swinging door 16 and its threshold.

In this way, the tendency to rising of the rear of the support 15 is counteracted by the swinging door 16.

Moreover, an edge projecting upwardly at the end of the tongue 17, provides an abutment preventing the support 15 from escaping from the door.

Moreover, the support 15 is connected to one end of resilient connector 19 connected at their other end to the harness 5.

By way of preferred example, the groups of elastic connectors 15 are disposed in pairs distributed on opposite sides of the harness 5.

The elastic connectors 19 could be formed by connectors of the Sandow (trademark) type or by any other elastic means.

The harness 5 as shown in FIGS. 6 to 8 has the advantage of ensuring a comfortable application of force to the thighs of the user.

Of course, any other form of harness 5 consistent with applying a resistive force at the level of the thighs, is within the scope of the present invention.

REFERENCES

1. Frame
2. Load
3. Pulleys
4. Cable
5. Harness
6. Support surface
7. Seat
8. Plate
9*a*, 9*b*. Concave surfaces
10*a*, 10*b*. Oblong holes
11*a*, 11*b*. Handles
12*a*, 12*b*. Guide bars
13*a*, 13*b*. Sliding connections
14. Transverse bar
15. Support
16. Door
17. Tongue
18. Floor
19. Elastic connectors

The invention claimed is:

1. A device for the muscular exercise of an individual, usable for developing the quadriceps and the buttocks muscles, comprising:

an inclined plane whose rear portion is elevated, said inclined plane being arranged to receive feet of an individual whose heels are at said rear portion;

a harness with two concave surfaces arranged to lie across an upper surface of thighs of the individual; and a resistance attached to said harness that resists movement of said harness away from said inclined plane as legs of the individual move from a bent position to an extended position by straightening the knees.

2. The device according to claim 1, wherein said harness comprises a plate to which said two concave surfaces are movably attached so that spacing and orientation of said two concave surfaces are adjustable.

3. The device according to claim 2, wherein said two concave surfaces comprise a pair of inverted arcuate seats and said plate comprises longitudinal slots that slidably carry said seats.

4. The device according to claim 2, wherein said plate comprises handles extending from longitudinal ends of said plate.

5. The device according to claim 1, wherein said inclined plane is perpendicular to a mean direction of a resistive force of said resistance.

6. The device according to claim 1, further comprising a seat above and behind the rear portion of said inclined plane.

7. The device according to claim 1, wherein said resistance comprises a cable fixed at one end to said harness between said two concave surfaces and at the other end to a vertically movable load, and pulleys guiding said cable.

8. The device according to claim 1, wherein said resistance comprises a transverse bar on which said harness is mounted, two oblique parallel guide bars along which said transverse bar is slidably mounted, and loads at ends of said transverse bar, and wherein said harness is pivotally mounted in a direction of said transverse bar.

9. The device according to claim 8, wherein said guide bars are parallel to a mean direction of a resistive force of said resistance.

10. The device according to claim 8, wherein said guide bars are perpendicular to said inclined plane.

11. The device according to claim 10, further comprising a seat between said guide bars and above and behind the rear portion of said inclined plane.

12. The device according to claim 1, wherein said inclined plane comprises a base with an attachment that secures said inclined plane to a support surface, and wherein said resistance comprises at least one elastic connector connected between said base and said harness.

13. The device according to claim 12, wherein said attachment comprises a tongue that extends from a rear bottom of said base, said tongue being arranged to fit between a door and adjacent threshold.

* * * * *